US007020907B2

(12) United States Patent
Holmes

(10) Patent No.: US 7,020,907 B2
(45) Date of Patent: Apr. 4, 2006

(54) LUXURY TOILET HAVING A RECLINING SEAT BACK

(76) Inventor: Rufus L. Holmes, 2217 Emerson St., Evanston, IL (US) 60201

( * ) Notice: Subject to any disclaimer, the term of this patent is extended or adjusted under 35 U.S.C. 154(b) by 0 days.

(21) Appl. No.: 10/782,000

(22) Filed: Feb. 19, 2004

(65) Prior Publication Data

US 2005/0183192 A1 Aug. 25, 2005

(51) Int. Cl.
*E03D 11/00* (2006.01)

(52) U.S. Cl. ..... 4/254

(58) Field of Classification Search ..... 4/234, 4/246.1, 254

See application file for complete search history.

(56) References Cited

U.S. PATENT DOCUMENTS 3,517,396 A * 6/1970 Wert ..... 4/234
4,055,864 A * 11/1977 Liu et al. ..... 4/253
6,904,622 B1 * 6/2005 Gabriel ..... 4/237

FOREIGN PATENT DOCUMENTS

JP 5-137670 * 5/1993

* cited by examiner

*Primary Examiner*—Charles E. Phillips

(57) ABSTRACT

The present invention is a reclining seat back assembly for a toilet. The reclining seat back assembly includes a seat back frame pivotally mounted to a first upper surface portion of a toilet base of the toilet, the seat back frame including a front surface, a first side edge, a second side edge and a bottom edge proximate to the first upper surface portion of the toilet base, a cushion mounted to the front surface, at least one button disposed on a side surface of the toilet base, the at least one button accessible by a user of the toilet, and a seat back operating assembly coupled to the seat back frame and the at least one button, the seat back operating assembly adapted to allow the user to selectively adjust an upright position of the seat back frame in response to actuation of the at least one button.

12 Claims, 4 Drawing Sheets

LUXURY TOILET HAVING A RECLINING SEAT BACK

FIELD OF THE DISCLOSURE

This invention is directed to sanitary facilities, and more particularly, to a luxury toilet having a reclining seat back.

BACKGROUND

Over the years, bathrooms have evolved from rooms that simply provide a utilitarian function, to rooms that provide places of refuge from the everyday stresses of life. As a result of improved fixture designs appearing in newer and renovated bathrooms, people are encouraged to spend time relaxing in such bathrooms. For example, many bathrooms now include an oversized soaking bathtub or water-jet bathtub. Many bathrooms also include elaborate, marble and glass shower stalls having multiple shower heads or spray jets, and sophisticated "vessel bowl" bathroom sinks.

Unfortunately, the bathroom toilet has not benefited from such design improvements. In fact, recent improvements to the traditional two-piece round toilet and the more modern one-piece elongated toilet have primarily been limited to aesthetic enhancements such as the addition of decorative enameled flowers and the like.

A small number of functional toilet improvements have been disclosed, however these disclosed improvements have not been widely accepted. Such improvements include, for example, the addition of a heated toilet seat as described in U.S. Pat. No. 5,940,895, or the addition of a toilet seat positioning assembly where the toilet seat can be either raised or lowered via an electric drive assembly that includes a foot pedal, as described in U.S. Pat. No. 6,539,557.

SUMMARY OF THE INVENTION

In general, the present invention provides a luxury toilet having a reclining back assembly. The reclining seat back assembly includes a seat back frame pivotally mounted to a first upper surface portion of a toilet base of the toilet, the seat back frame including a front surface, a first side edge, a second side edge and a bottom edge proximate to the first upper surface portion of the toilet base, a cushion mounted to the front surface, at least one button disposed on a side surface of the toilet base, the at least one button accessible by a user of the toilet, and a seat back operating assembly coupled to the seat back frame and the at least one button, the seat back operating assembly adapted to allow the user to selectively adjust an upright position of the seat back frame in response to actuation of the at least one button.

Additional aspects of the invention will be apparent to those of ordinary skill in the art in view of the detailed description of various embodiments, which is made with reference to the drawings, a brief description of which is provided below.

DESCRIPTION OF THE ILLUSTRATED EMBODIMENTS

The description of the illustrated embodiments is to be construed as exemplary only and does not describe every possible embodiment of the invention. Numerous alternative embodiments could be implemented, using either current technology or technology developed after the filing date of this patent, which would still fall within the scope of the claims defining the invention.

In general, the present invention provides a luxury toilet having a reclining back portion, among other improvements. As described below, the present invention is preferably implemented using a one-piece elongated toilet however other toilet configurations such as a two-piece round toilet, a bidet, etc., are contemplated.

An advantageous feature of a luxury toilet having a reclining back portion is that, unlike prior art toilet designs, the luxury toilet having the reclining back portion provides a comfortable and supportive place of rest for a user wishing to relax in the quiet environment of a bathroom.

Figure 1:
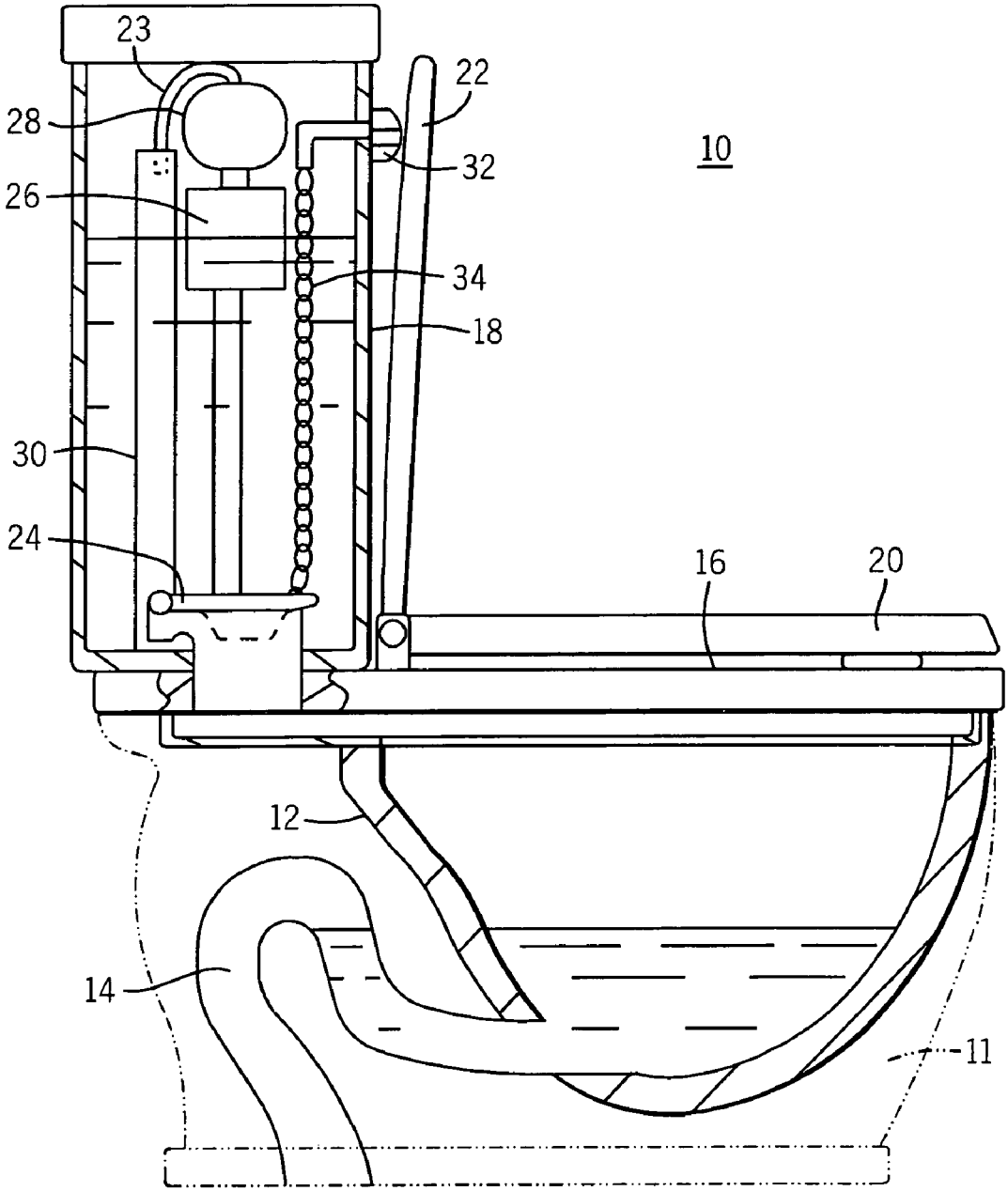
FIG. 1 PRIOR ART
FIG. 1 is a side view of an exemplary standard toilet as found in the prior art.

FIG. 1 is a side view of an exemplary prior art standard toilet 10. Referring to FIG. 1, the exemplary standard toilet 10 includes a toilet base 11 and a tank 18 containing, among other things, a couple of gallons of water. The toilet base 11 includes a bowl 12, a bowl siphon 14 and a rim 16. The bowl siphon 14 is typically molded into the bowl 12. A seat 20 and a seat back 22 are pivotally mounted to a rear portion of the rim 16 such that the seat 20 and/or the seat back 22 can be manually raised and lowered. The seat 20 and a seat back 22 may be in one of two positions; an open position or vertically raised position (i.e., when the seat 20 and/or the seat back 22 are pivoted ninety degrees from a horizontal position) and a closed position. The tank 18 provides a stop point when the seat 20 and/or the seat back 22 are in the open position. The tank 18 houses a tank valve assembly 23 that includes a flush valve 24, a filler float 26, a filler valve 28 and an overflow tube 30. A handle 32 mounted to the outside of the tank 18 is operatively coupled to the flush valve 24 via a chain 34.

After toilet use, when the handle 32 is activated to remove toilet contents, movement of the coupled chain 34 causes the flush valve 24 to lift, allowing water from the tank 18 to be quickly passed via an exposed two to three inch drain hole into the bowl 12. Depending on the toilet design, some of the water from the tank 18 may also flow into, and then drain out of, holes in the rim 16. As a result of the siphoning action of the bowl siphon 14, the toilet contents are displaced by the water delivered from the tank 18 via the open flush valve 24, and the tank 18 is refilled with fresh water. When the tank 18 is emptied of water, the flush valve 24 resituates itself in the bottom of the tank 18, covering the drain hole so the tank 18 can be refilled with water. A refill mechanism (not separately illustrated) refills the tank 18 with enough water to allow the next toilet flush. The refill mechanism includes a valve that turns the water on and off, depending on the level of the filler float 26.

Unfortunately, while functional in use, the standard toilet 10 is not designed for comfort during long periods of sitting. This is primarily because the seat back 22 is typically made of molded plastic, is not ergonomically designed for comfort and has only one upright position, the open position. Although some previous toilet designs have addressed comfort of the seat 20, personal hygiene design improvements (i.e., bidet toilet with warm water cleansing units), anti-clogging designs, etc., they failed to address comfort of the seat back 22.

Figure 2:
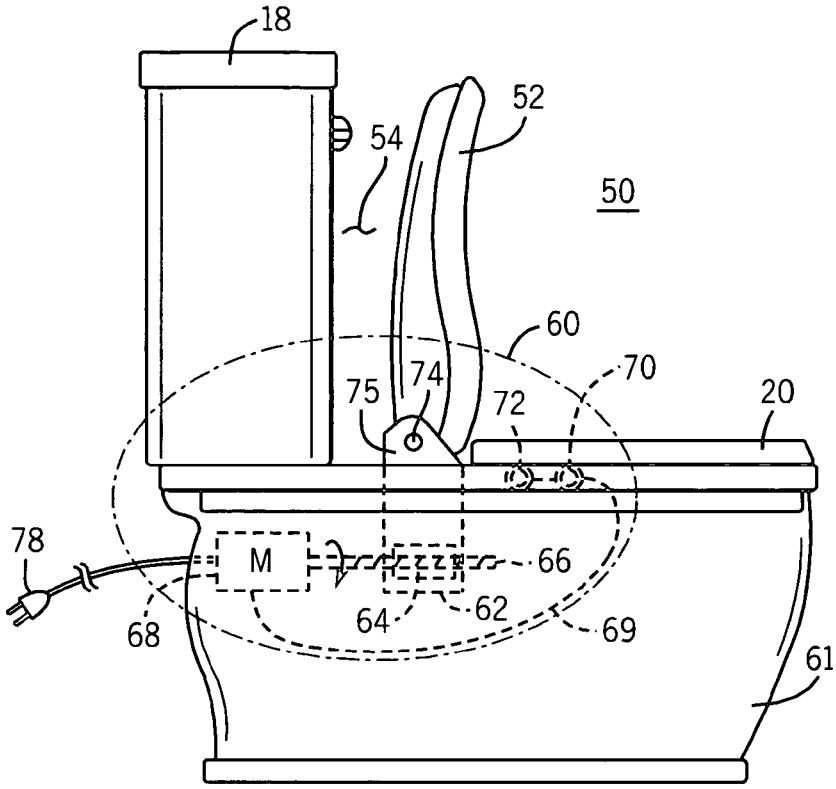
FIG. 2 is a side, partially cut-away view of a luxury toilet having a reclining seat back according to an embodiment of the invention.

FIG. 2 is a side view of a luxury toilet 50 including a reclining seat back 52 according to an embodiment of the invention. In the illustrated example, the luxury toilet 50 also includes a tank 18 having a tank valve assembly (not separately illustrated) and a toilet base 61 having a bowl formed therein for receiving water from the tank 18 via the tank valve assembly. Unlike the standard toilet 10 of FIG. 1, an area 54 is provided between the reclining seat back 52 and a front side of the tank 18 of the luxury toilet 50 of FIG. 2. The area 54, defined by a predetermined linear distance between the tank 18 and the reclining seat back 52 allows the reclining seat back 52 to recline beyond the vertically raised position of the standard toilet of FIG. 1 (i.e., ninety degrees from a horizontal position). Addition of the area 54 between the reclining seat back 52 and the tank 18, while still providing proper tank capacity and proper stub-out placement (e.g., twenty-eight inches from a wall) for water drainage to a sewer or septic system, may be accomplished in any one of a number of ways. For example, addition of area 54 may be accomplished by decreasing the width and increasing the height of the tank 18 and/or repositioning the bowl siphon 14 outlet to accommodate standard stub-out requirements.

Figure 3:
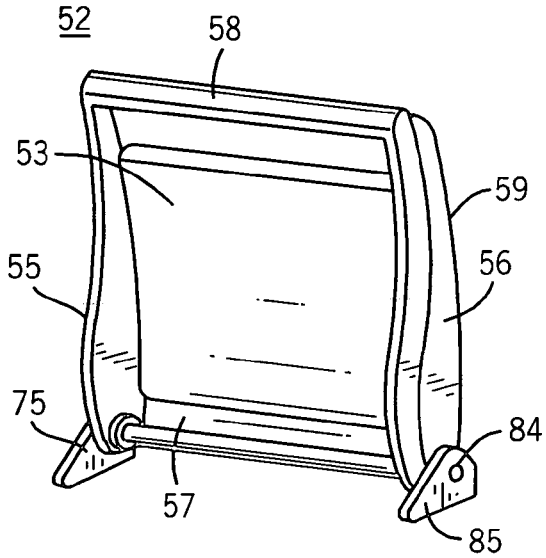
FIG. 3 is a perspective view of the reclining seat back of FIG. 2.

FIG. 3 is a perspective view of the reclining seat back 52. The reclining seat back 52 includes a seat back frame 59 fitted with an ergonomically contoured cushion 53 for support and comfort of the user. The seat back frame 59 is preferably made of a molded plastic material and has a first side edge 55, a second side edge 56, a bottom edge 57 pivotally hinged to a first upper surface portion of the toilet base 61. Although the cushion 53 is preferably a leather cushion, it may be a vinyl cushion, a fabric cushion, etc., or any other type cushion providing suitable comfort. In addition, although the reclining seat back 52 includes the seat back frame 59 fitted with the cushion 53, it is contemplated that the reclining seat back 52 may be any suitable reclining seat back configured for a user's comfort and functionality.

Referring again to FIG. 2, the luxury toilet 50 also includes a seat back operating assembly 60 (see also, FIGS. 4 and 5) disposed in the toilet base 61. The seat back operating assembly 60 is configured to allow a user to selectively adjust the upright seat position of, or recline, the reclining seat back 52, and is preferably configured to be concealed within the toilet base 61. Although enabled in the illustrated example via a worm gear assembly, the seat back operating assembly 60 may be configured using one of many other types of mechanical or electromechanical assemblies.

The seat back operating assembly 60 preferably includes a first side extension bracket 62 attached to, or forming part of, a first bottom edge location of the reclining seat back 52 and extending into the toilet base 61, a worm gear block 64 disposed in the first side extension bracket 62 where the worm gear block 64 includes a threaded hole therein, a motor assembly 68 electrically coupled to a first control button 70 and a second control button 72, and a worm gear drive shaft 66 rotatably coupled to the motor assembly 68 and threadedly coupled to the worm gear block 64 via the threaded hole. Thus, the worm gear block 64 is sized to receive the worm gear drive shaft 66 via the threaded hole. The first and second control buttons 70, 72 are preferably coupled to the motor assembly 68 via a wire connection 69. As a result, rotation of the worm gear drive shaft 66 by the motor 68 causes reciprocal lateral motion of the worm gear block 64 depending upon the rotation direction of the worm gear drive shaft 66.

Referring to FIGS. 2–5, a first mounted bracket 75, configured to receive a first pin 74 fixedly attached to the bottom portion of the first side edge 55, is coupled to a second upper surface portion of the toilet base 61 where the second upper surface portion is adjacent to a bottom portion of the first side edge 55 of the seat back frame 59. The first mounted bracket 75 is preferably made of a ceramic or plastic material that visually blends with the toilet base 61. Alternatively, the first pin 74 may be fixedly attached to the first side extension bracket 62 (see, FIG. 5) to enable ease of movement when fully reclining the seat back frame 59. Further, an electrical cord 78, coupled to the motor 68, extends from a back side of the bottom portion of the toilet base 61 and mates with a wall electrical outlet (not separately illustrated) to provide electrical power to the motor assembly 68 disposed in the toilet base 61.

Figure 4:
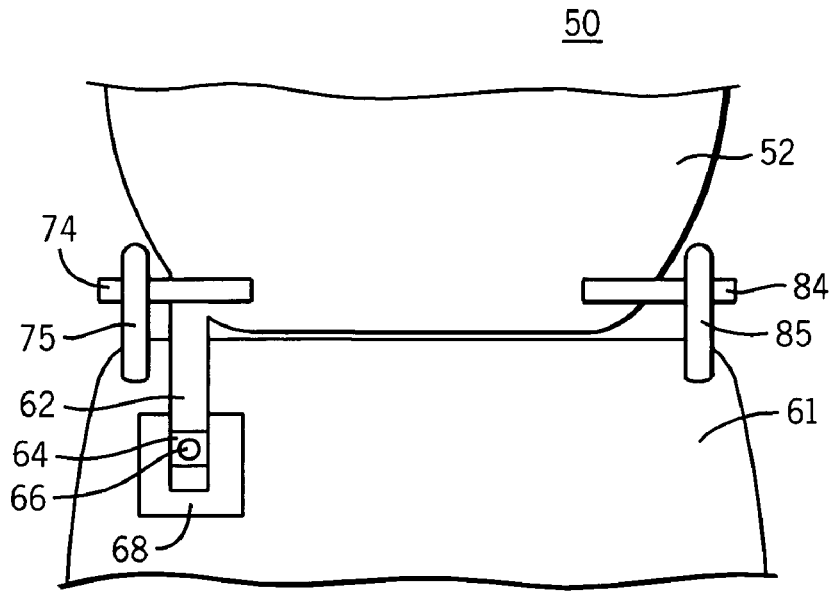
FIG. 4 is a partial front view of the luxury toilet having the reclining seat back according to an embodiment of the invention.
Figure 5:
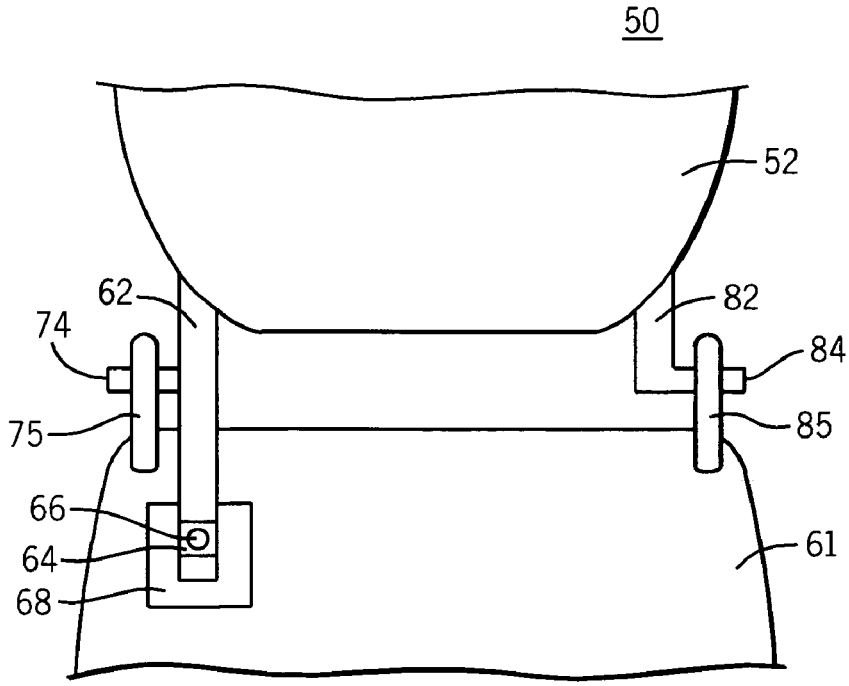
FIG. 5 is another partial front view of the luxury toilet having the reclining seat back according to another embodiment of the invention.

FIG. 4 is a partial front view of the luxury toilet 50 including the seat back 52. In addition to the components depicted in FIG. 2, FIG. 4 illustrates a second bracket 85, configured to receive a second pin 84 fixedly attached to the bottom portion of the second side edge 56, is coupled to a second upper surface portion of the toilet base 61, where the second bracket 85 is coupled to a third upper surface portion of the toilet base 61, and where the third upper surface portion is adjacent to a bottom portion of the second side edge 56 of the seat back frame 59. The second pin 84, projecting in a horizontal direction opposite to the first pin 74, is fixedly attached to the bottom portion of the second side edge 56. Alternatively, the second pin 84 may be fixedly attached to a second side extension bracket 82 (see, FIG. 5) to enable ease of movement when fully reclining the reclining seat back 52. Thus, the first and second pins 74, 84 projecting into the apertures of the first and second mounted brackets 75, 85, provide a fixed horizontal pivot axis for the reclining seat 52 as it is reclined upon actuation of the first and/or second control button(s) 70, 72.

Figure 6:
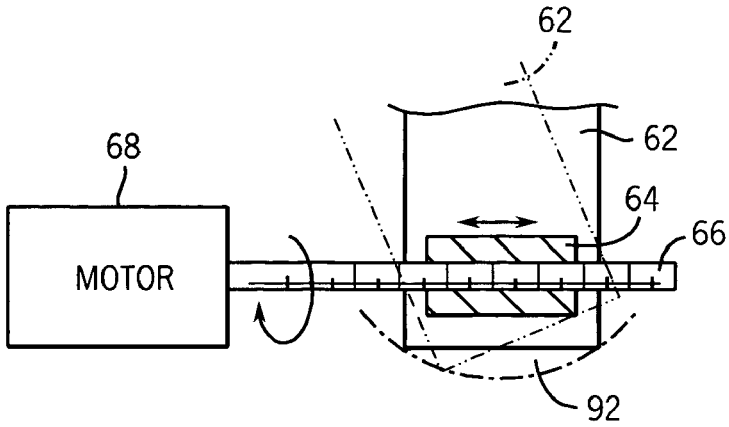
FIG. 6 is a detailed view of a drive system for the reclining seat back of FIG. 2.

FIG. 6 is a detailed view of the seat back operating assembly 60. During operation, upon depressing the first button 70 (see, FIG. 2), the bottom of the seat extension bracket 62 is forced in a forward direction relative to the front of the luxury toilet 50 via a first direction of rotation (e.g., clockwise) of the worm gear drive shaft 66 in the worm gear block 64. Worm gear block 64 is attached to bracket 62 to provide allowance for the slight angular movement of the bracket 62 relative to the axis of rotation of the worm gear drive shaft 66, as is known in the art. As a result, the seat back 52 is reclined. A concave clearance area 92 below the bottom of the seat extension bracket 62 is sized to accommodate movement of the seat extension bracket bottom within the toilet base 61. The seat back 52 may be reclined to one of an infinite number of positions between a substantially vertical position and a stop position defined by the location of the tank 18.

Upon depressing the second button 72 (see, FIG. 2), the bottom of the seat extension bracket 62 is forced in a backward direction relative to the front of the luxury toilet 50 via a second direction of rotation (e.g., counter-clockwise) of the worm gear drive shaft 66 in the worm gear block 64. As a result, the seat back 52 is inclined forward (i.e., declined).

Although, the luxury toilet 50 including a reclining seat back 52 includes a first and second button 70, 72, other button configurations are contemplated. In addition, although the luxury toilet 50 includes a seat back operating assembly 60 configured as a worm gear assembly, other reclining assemblies are contemplated. For example, a motor assembly 68 may additionally include a controller (having a microprocessor and a memory) coupled to the first and second buttons 70, 72, and may be configured to operate the reclining seat back 52 and/or attached peripheral devices (e.g., a foot rest, and arm rest, a speaker phone, or any number of other devices), in response to button activation.

Figure 7:
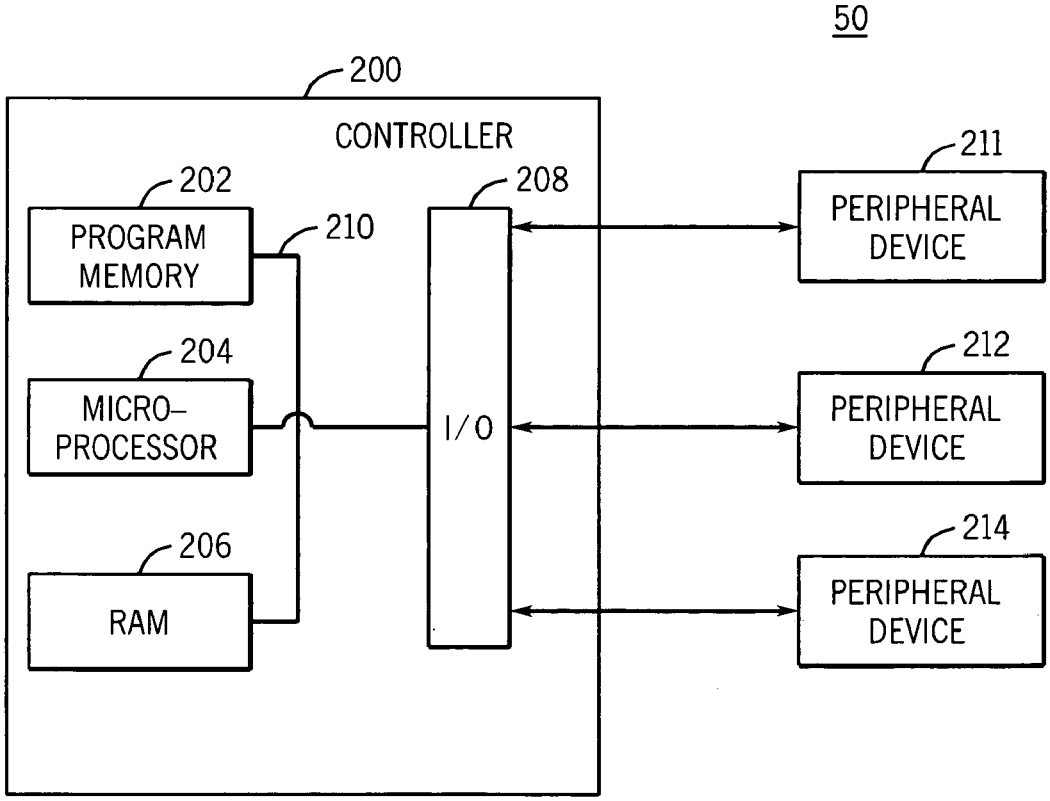
FIG. 7 is a block diagram of a controller that may be utilized in the luxury toilet of FIG. 2.

FIG. 7 is a block diagram of a controller 200 that may be utilized in the luxury toilet 50 to control movement of the reclining seat back 52 and other peripheral device(s) coupled to the luxury toilet 50. The controller 200 includes a program memory 202 (including a read only memory (ROM)), a microcontroller-based platform or microprocessor (MP) 204, a random-access memory (RAM) 206 and an input/output (I/O) circuit 208, all of which may be interconnected via a communications link, or an address/data bus 210. The microprocessor 204 is capable of causing coupled devices (e.g., the reclining seat back 52) to move, activate, or deactivate. The RAM 206 is capable of storing event data or other data used or generated during movement, activation or deactivation of the coupled devices of the luxury toilet 50. The program memory 202 is capable of storing program code that controls the coupled devices of the luxury toilet 50 so that it operates in accordance with applicable requirements. It should be appreciated that although only one microprocessor 204 is shown, the controller 200 may include multiple microprocessors 204. Similarly, the memory of the controller 200 may include multiple RAMs 206 and multiple program memories 202. Although the I/O circuit 208 is shown as a single block, it should be appreciated that the I/O circuit 208 may include a number of different types of I/O circuits. The RAM(s) 206 and program memory(s) 202 may be implemented as semiconductor memories, magnetically readable memories, and/or optically readable memories, etc. Further, the term "controller" is used herein to refer collectively to the program memory 202, the microprocessor 204, the RAM 206 and the I/O circuit 208.

FIG. 7 illustrates that multiple peripheral devices, depicted as peripheral devices 211, 212, and 214, may be operatively coupled to the I/O circuit 208. In addition to the reclining seat back 52, the peripheral devices may include the seat 20, a footrest, a speaker phone, etc. Therefore, in addition to being coupled to the first and second control buttons 70, 72, and the motor 68, the controller 200 may be also coupled to a footrest assembly, a phone assembly, etc. Although three peripheral devices are depicted, more or less peripheral devices may be included.

It should be appreciated that although the controller 200 is a preferable implementation of the present invention, the present invention may also include implementation via one or more application specific integrated circuits (ASICs), field programmable gate arrays (FPGA), adaptable computing integrated circuits, one or more hardwired devices, or one or more mechanical devices.

As is apparent from the above discussion, although operationally similar, the luxury toilet 50 provides improved comfort over the standard toilet 10.

From the foregoing, it will be observed that numerous variations and modifications may be affected without departing from the scope of the novel concept of the invention. It is to be understood that no limitations with respect to the specific methods and apparatus illustrated herein is intended or should be inferred. It is, of course, intended to cover by the appended claims all such modifications as fall within the scope of the claims.

It is claimed:

1. A reclining seat back assembly for a toilet including a tank and toilet base having a bowl formed therein, the seat back assembly comprising:

a seat back frame pivotally mounted to a first upper surface portion of the toilet base, the seat back frame including a front surface, a first side edge, a second side edge and a bottom edge proximate to the first upper surface portion of the toilet base, and including a first pin mounted to the first side edge of the seat back frame, the first pin configured to project into the first aperture, and a second pin mounted to the second side edge of the seat back frame, the second pin configured to project into the second aperture, the second pin projecting in a horizontal direction opposite to the first pin to provide a fixed horizontal pivot axis;

a cushion mounted to the front surface;

at least one button disposed on a side surface of the toilet base, the at least one button accessible by a user of the toilet;

a seat back operating assembly coupled to the seat back frame and the at least one button, the seat back operating assembly adapted to allow the user to selectively adjust an upright position of the seat back frame in response to actuation of the at least one button, the seat back operating assembly including a side extension bracket attached to a bottom portion of the first side edge of the seat back frame, the side extension bracket extending to the toilet base, and including a worm gear block attached to the side extension bracket, the worm gear block having a threaded hole disposed therein, a motor assembly electrically coupled to at least one button, and a worm gear drive shaft rotatably coupled to the motor assembly and threadedly coupled to the worm gear block, the worm gear drive shaft sized for receipt by the threaded hole;

a first mounted bracket having a first aperture disposed therein, the first mounted bracket fixedly attached to a second upper surface portion of the toilet base, the first mounted bracket proximate to the first side edge of the seat back frame; and a second mounted bracket having a second aperture disposed therein, the second mounted bracket fixedly attached to a third upper surface portion of the toilet base, the second mounted bracket proximate to the second side edge of the seat back frame.

2. The seat back assembly of claim 1, wherein the seat back operating assembly is concealed within the toilet base.

3. The seat back assembly of claim 1, wherein the motor assembly further comprises a controller, the controller including a microprocessor and a memory coupled to the microprocessor.

4. The seat back assembly of claim 1, wherein a bottom portion of the side extension bracket is forced in a first substantially lateral direction in response to a first direction of rotation of the worm gear shaft, and wherein the bottom portion of the side extension bracket is forced in a substantially lateral second direction in response to a second direction of rotation of the worm gear shaft, the substantially lateral second direction opposite to the substantially lateral first direction, the second direction of rotation opposite to the first direction of rotation.

5. A luxury toilet comprising:

a tank including a tank valve assembly disposed therein, the tank including a front side and a back side;

toilet bas operatively coupled to the tank, the toilet base having a bowl formed therein for receiving water from the tank via the tank valve assembly;

a reclining seat back assembly coupled to the toilet base, the reclining seat back assembly including:

a reclining seat back pivotally coupled to a first upper surface portion of the toilet base, the reclining seat back including a first side edge, a second side edge, a bottom edge proximate to the first upper surface portion of the toilet base, and a first pin and a second pin, the first upper surface portion of the toilet base at a predetermined distance from the front side of the tank to allow reclining adjustment of the reclining seat back, the first pin mounted to the first side edge of the seat back and configured to project into the first aperture, the second pin mounted to the second side edge of the seat back and configured to project into the second aperture, the second pin projecting in horizontal direction opposite to the second pin to provide a fixed horizontal pivot axis, at least one button disposed on a side surface of the toilet base, the at least one button accessible by a user of the luxury toilet, and a seat back operating assembly coupled to the seat back and the at least one button, the seat back operating assembly adapted to allow the user to selectively adjust an upright reclining position of the seat back in response to actuation of the at least one button, the seat back operating assembly concealed within the toilet base, the seat back operating assembly including a side extension bracket attached to a bottom portion of the first side edge of the seat back and extending into the toilet base, a worm gear block attached to the side extension bracket and having a threaded hole disposed therein, a motor assembly electrically coupled to the at least one button, and a worm gear drive shaft rotateably coupled to the motor assembly and threadedly coupled to the worm gear block, the worm gear drive shaft sized for receipt by the threaded hole;

a first mounted bracket having a first aperture disposed therein, the first mounted bracket fixedly attached to a second upper surface portion of the toilet base, the first mounted bracket proximate to the first side edge of the seat back; and a second mounted bracket having a second aperture disposed therein, the second mounted bracket fixedly attached to a third upper surface portion of the toilet base, the second mounted bracket proximate to the second side edge of the seat back.

6. The luxury toilet of claim 5, wherein the motor assembly further comprises a controller, the controller including a microprocessor and a memory coupled to the microprocessor.

7. The luxury toilet of claim 5, wherein a bottom portion of the side extension bracket is forced in a first substantially lateral direction in response to a first direction of rotation of the worm gear shaft, and wherein the bottom portion of the side extension bracket is forced in a substantially lateral second direction in response to a second direction of rotation of the worm gear shaft, the substantially lateral second direction opposite to the substantially lateral first direction, the second direction of rotation opposite to the first direction of rotation.

8. A reclining seatback assembly for a toilet, the toilet including a tank and toilet base having a bowl formed therein, the seat back assembly comprising:

a seat back pivotally mounted to a first upper surface portion of the toilet base, the seat back including a side edge, a second side edge and a bottom edge proximate to the first upper surface portion of the toilet base;

at least one button disposed on a side surface of the toilet base, the at least one button accessible by a user of the toilet; and a seat back operating assembly coupled to the seat back and the at least one button, the seat back operating assembly adapted to allow the user to selectively adjust an upright position of the seat back in response to the actuation of the at least one button, the seat back operating assembly including:

a first side extension bracket attached to a bottom portion of the first side edge of the seat back, the first side extension bracket extending the toilet base, a second side extension bracket attached to a bottom portion of the second side edge of the seat back, the second side extension bracket substantially parallel to the first side extension bracket, a worm gear block attached to the first side extension bracket, the worm gear block having a threaded hole disposed therein, a motor assembly electrically coupled to the at least one button, and a worm gear drive shaft rotateably coupled to the motor assembly and threadedly coupled to the worm gear block, the worm gear drive shaft sized for receipt by the threaded hole.

9. The seat back assembly of claim 8, wherein the seat back operating assembly is concealed within the toilet base.

10. The seat back assembly of claim 8, wherein the motor assembly further comprises a controller, the controller including a microprocessor and a memory coupled to the microprocessor.

11. The seat back assembly of claim 8, wherein the toilet further includes:

a first mounted bracket having a first aperture disposed therein, the first mounted bracket fixedly attached to a second upper surface portion of the toilet base, the first mounted bracket proximate to the first side edge of the seat back; and a second mounted bracket having a second aperture disposed therein, the second mounted bracket fixedly attached to a third upper surface portion of the toilet base, the second mounted bracket proximate to the second side edge of the seat back.

12. The seat back assembly of claim 11, wherein the seat back further comprises:

a first pin mounted to the first side extension bracket, the first pin configured to project into the first aperture; and a second pin mounted to the second side of the extension bracket, the second pin configured to project into the second aperture, the second pin projecting in a horizontal direction opposite to the second pin to provide a fixed horizontal pivot axis.

* * * * *